106-90 AU 11 EX
10/13/87 X3 4,699,822

United States Patent [19]
Shu

[11] Patent Number: 4,699,822
[45] Date of Patent: Oct. 13, 1987

[54] FIREPROOFED METAL STRUCTURAL MEMBERS AND METHOD OF FABRICATING SAME

[75] Inventor: Larry S. Shu, Newton Highlands, Mass.

[73] Assignee: W. R. Grace & Co., Cambridge, Mass.

[21] Appl. No.: 771,527

[22] Filed: Aug. 30, 1985

[51] Int. Cl.[4] ..... B32B 27/14; B32B 3/00; B27N 9/00; C04B 7/02

[52] U.S. Cl. ..... 428/198; 428/209; 428/701; 428/920; 428/921; 106/90; 52/347

[58] Field of Search ..... 428/920, 921, 198, 209, 428/701; 106/90, 93; 52/347, 349

[56] References Cited

U.S. PATENT DOCUMENTS

| | | | |
|---|---|---|---|
| 2,992,131 | 7/1961 | Bricknell et al. | 117/70 |
| 3,104,982 | 9/1963 | Shanley | 117/70 |
| 3,153,596 | 10/1964 | Tallentire et al. | 106/105 |
| 3,369,929 | 9/1962 | Petersen | 117/127 |
| 3,454,456 | 7/1969 | Willey | 161/162 |
| 3,719,513 | 3/1973 | Bragg et al. | 106/114 |
| 3,839,059 | 10/1974 | Rothfelder et al. | 106/115 |
| 3,913,290 | 10/1975 | Billing et al. | 52/347 |
| 4,132,555 | 1/1979 | Barrable | 106/90 |
| 4,166,749 | 9/1979 | Sterrett et al. | 106/93 |
| 4,312,260 | 1/1982 | Morieras | 87/1 |
| 4,327,146 | 4/1982 | White | 428/308 |
| 4,395,159 | 7/1983 | Karuks et al. | 405/172 |
| 4,419,853 | 12/1983 | Failmezger | 52/741 |
| 4,477,533 | 10/1984 | Phillips | 428/458 |
| 4,569,878 | 2/1986 | Barrall et al. | 428/182 |

*Primary Examiner*—John E. Kittle
*Assistant Examiner*—Patrick J. Ryan
*Attorney, Agent, or Firm*—John J. Wasatonic; William L. Baker

[57] ABSTRACT

Fire and heat resistant metal structural members and a method of fabricating same are provided. The structural members of the invention comprise a metal substrate element, a discontinuous tie coat layer comprising an inorganic binder adhered to a surface of the structural element, and a continuous layer of a hydraulic cement-based fireproofing composition adhered to the tie coat layer and the exposed areas of the metal substrate. The discontinuous tie coat layer of the inventive structural members can substantially diminish or prevent the delamination of the fireproofing layer from the metal substrate under ambient temperature and high heat conditions.

25 Claims, 3 Drawing Figures

FIREPROOFED METAL STRUCTURAL MEMBERS AND METHOD OF FABRICATING SAME

This invention relates to fireproofed metal structural members for buildings and the like, and, in particular, to such members containing a tie coat layer which substantially prevents the delamination of the applied fireproofing composition from the structural member.

It is a well known practice in the construction trade to apply cementitious fireproofing compositions to metal structural members such as steel I-beams and floor decks. The fireproofing composition prevents or slows distortion or destruction of the member under high heat conditions. The fireproofing compositions which have been most widely accepted are the hydraulic cement based compositions comprising an inorganic hydraulic cement binder component such as Plaster of Paris or Portland cement. These compositions are normally spray applied and are self-adherent to the metal substrate. Compositions of this type are described in U.S. Pat. Nos. 3,369,929; 3,719,513; and 3,839,059.

In general, the self adherence of the spray applied fireproofing compositions to the metal substrate provides a satisfactory bond with the metal surface and a separate or supplemental bonding means has not been employed. In recent years, however, it has been observed that the self adherence of these compositions to the lighter gauge steels and the smoother surfaced steels, both of which have become more prevalent in construction during that time, may not provide a satisfactory bond for all conditions of use. Thus, the hydraulic cement base fireproofing compositions may prematurely delaminate from these substrates, either under the normal conditions of use or under the high temperature environment created by a fire.

The tendency of the fireproofing compositions to delaminate prematurely from the lighter gauge steel plate is attributable to the greater flexibility of this plate, as opposed to that of heavier gauge steel. The greater degree of flexibility is, in turn, due to its relative thinness, which is, in the range of 1/64 inch to ¼ inch. Flexing or bending of the plate thus occurs more readily, either under ambient temperature conditions or the high temperature environment of a fire. At ambient temperature, the flexing or bending may be caused, for example, by building movement, such as the swaying of high rise buildings, or foot traffic on a floor or roof deck. At elevated temperatures, flexing or bending may occur as a result of thermal expansion of the steel, creep, or strength degradation of the steel. The flexing of the steel plate creates shear stresses at the interface of the flexible plate and the relatively rigid fireproofing composition. These shear stresses can exceed the bond strength between the plate and the fireproofing, leading to a breaking of the bond therebetween and delamination of the fireproofing.

In the case of the smoother surfaced steels, the relatively smooth surface can be the result of improved galvanizing techniques, resulting in a smoother layer of the galvanizing composition on the steel, or the application of corrosion resistant primer costs. The tendency of the fireproofing compositions to delaminate from these smooth surfaced steels results from a decrease in the bond strength therebetween. The decreased bond strength is due, at least in part, to the smaller available bonding area presented by the smooth surface. In addition, certain primer coats may be inherently less adherent to the fireproofing composition than is the underlying steel substrate, thus further contributing to a weaker bond between the fireproofing and steel. Delamination of the fireproofing compositions is thus more likely to occur with such steels, both at ambient temperature and at the high temperatures occurring in a fire.

There is thus an increasing need in the construction fireproofing industry to increase the bond strength of hydraulic cement-based fireproofing compositions to metal structural members. More particularly, there has been a need to increase the bond strength sufficiently to prevent premature delamination of these fireproofing compositions from the lighter gauge steels and smoother surfaced steels referred to above, both under ambient temperature and fire test temperature conditions. In addition, it has been desired to attain such increased bond strength by a method which would be capable of easy application in the field and which would not entail a prohibitive increase in cost.

SUMMARY OF THE INVENTION

The present invention is directed to a method of substantially preventing the premature delamination of hydraulic cement-based fireproofing compositions from metal substrates and to the resulting fireproofed metal structural members. According to this invention, it has been found that the incidence of premature delamination of a hydraulic cement-based fireproofing composition from metal substrates can be prevented or substantially decreased by providing a discontinuous, inorganic binder-bsaed tie coated layer between the fireproofing composition and metal substrate. In particular, it has been found that premature delamination from the lighter gauge and the smoother surface steels referred to above can be prevented or substantially decreased through the use of the discontinuous tie coat layer of this invention.

The present invention is thus directed to fire and heat resistant structural members comprising a metal substrate, a discontinuous tie coat layer comprising an inorganic binder, the tie coat layer being adhered to a surface of the metal substrate, and a layer of a hydraulic cement-based fireproofing composition adhered to the tie coat layer and to the exposed areas of the substrate surface. The "exposed" areas of the substrate surface are those areas of the surface which is to be fireproofed which are not covered by the tie coat composition. These areas are thus contacted with and directly adhered to the fireproofing composition.

It its method aspects, the present invention is directed to a method fabricating the fire and heat resistant structural members of this invention, the method comprising the steps of applying a settable tie coat composition comprising an inorganic binder to a surface of a metal structural element in a discontinuous manner to form a discontinuous tie coat layer and then applying a continuous layer of a hydraulic cement-based fireproofing composition to the tie coat layer and to the exposed area of the metal structural element surface. The method of this invention can be used to fabricate structural elements in which delamination of the fireproofing layer under conditions of high heat or fire is prevented or substantially diminished.

The present invention is more fully described in the following detailed description, which is to be taken in connection with the accompanying drawings.

DETAILED DESCRIPTION OF THE INVENTION

The fireproofed structural members of this invention can be of any shape or form and used for any construction purpose. Although such members will generally be used in the construction buildings, the present invention broadly contemplates and includes structural members used for any type of interior or exterior construction, e.g., metal trusses or beams used as exterior or interior support members in plants or factories. The structural member comprises a metal structural element which serves as a substrate for the fireproofing composition. Typical examples of such metal structural elements are steel I-beams and flat or corrugated steel plates. It is the metal structural element, per se, which is to be protected from heat and fire and, for that purpose, the fireproofing composition is applied to one or more of its surfaces. The metal element may be coated, e.g., with a corrosion resistant primer, or galvanized prior to application of the fireproofing composition, and may thus possess the relatively smooth surface referred to above. The lighter gauge steel plate referred to above may also be used as the metal structural element, or substrate, of the present structural members.

Positioned between the metal substrate and the fireproofing composition is a discontinuous tie-coat layer. As used herein, the term "discontinuous" refers to a layer which does not completely cover the underlying metal substrate and thus leaves a portion of the substrate surface exposed. The fireproofing composition which is positioned over the tie coat layer thus contacts and adheres to both the tie coat layer and those portions of the metal substrate surface not covered by the tie coat layer.

Figure 1:
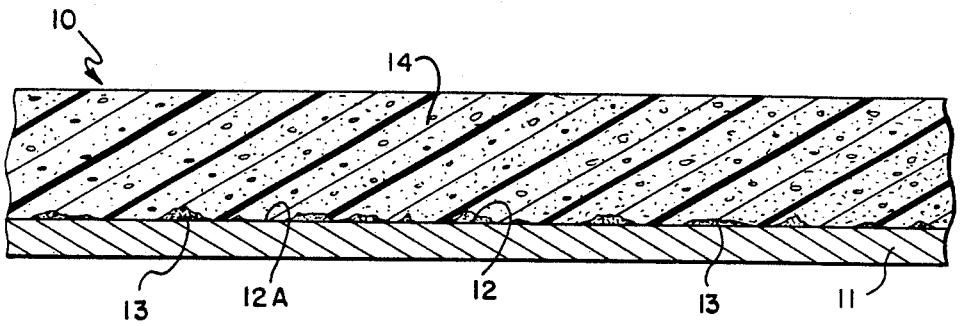
FIG. 1 is a diagrammatic, cross-sectional view of a fireproofed structural member of this invention in which the dimensions of the various components are non-proportional.

A typical fireproofed structural member of this invention is illustrated in the accompanying FIG. 1. In FIG. 1, the fireproofed structural member 10 is shown in cross section to comprise a metal substrate 11 having adhered to its surface 12 a discontinuous tie coat layer 13, shown to be a randomly arranged array of discreet quantities of the tie coat composition. A layer 14 of a fireproofing composition is contacted with and adhered to both the tie coat layer 13 and those areas of the substrate surface (some of which are designated 12a in FIG. 1) that are not covered by the tie coat layer.

Figure 2:
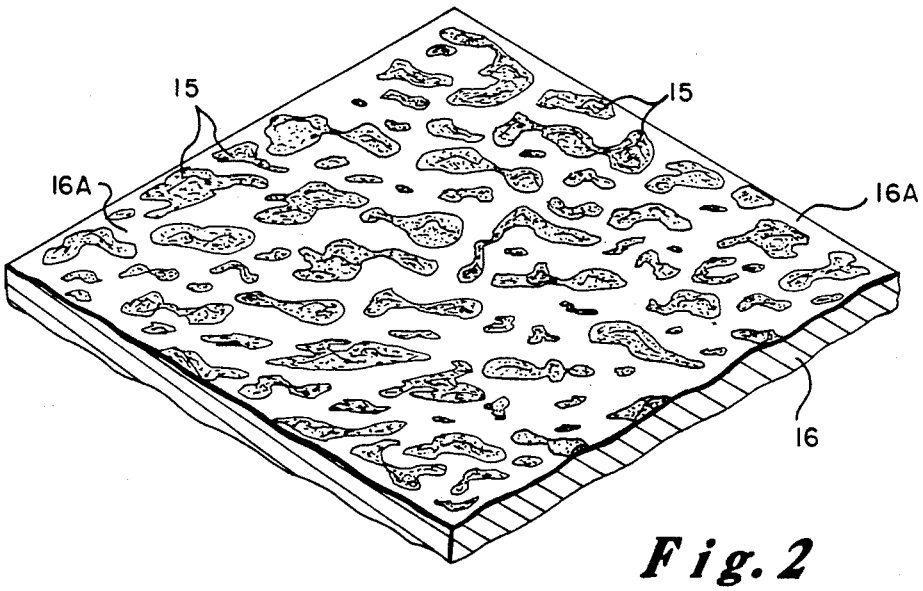
FIG. 2 is an elevated perspective view of a metal substrate having a tie coat layer of the invention applied to one of its surfaces.

FIG. 2 provides a perspective view of a tie coat layer of the invention on a metal substrate prior to application of the fireproofing composition. In FIG. 2, the discontinuous tie coat layer 15 is shown to consist of discreet segments which occupy or cover different amounts of the surface of the metal substrate 16 and have different shapes and thicknesses. As in FIG. 1, the tie coat layer 15 does not cover portions of the substrate 16, and some of these areas are designated **16*a* in FIG. 2. The average thickness of the tie coat layer is appreciable, such that, together with the areas 16*a*, the layer provides a pronounced three dimensional surface for bonding with the fireproofing composition. The total area of the three dimensional surface, consisting of the tie coat layer surface area and the exposed areas of the substrate surface, is considerably greater than that of the surface 16**. There is thus an increased area of contact and adherence with the applied fireproofing and, as a result, a stronger bond is formed with the fireproofing than would be formed without the interposition of the tie coat layer. Stronger bonding of the fireproofing composition may also occur because it is inherently more adherent to the tie coat composition that to the metal substrate.

With the stronger bond formed between the fireproofing composition and the substrate/tie coat surface, the fireproofing composition will not delaminate as readily under conditions causing shear stress or as a result of a smoother surface on the metal substrate. However, the benefits of this stronger bonding are dependent on maintaining as well the bond between the tie coat layer and metal substrate. It will be appreciated that a tie coat layer may also be subject to premature delamination as a result of shear stresses at the interface between that layer and the metal substrate. It has been found that, depending on the nature of the tie coat composition and the metal substrate, a continuous tie coat layer can undergo substantial delamination from the substrate under conditions of shear stress, with the result that both the tie coat layer and the overlying fireproofing composition are released from the metal surface. It has also been found that the provision of discontinuities in such tie coat layers can substantially diminish, and in most instances prevent, the delamination of that layer from the metal substrate. By providing a sufficient level of discontinuity in the tie coat layer, it is made sufficiently flexible to satisfactorily accomodate and adapt to flexing or deformation of the metal substrate. As a result, the level of shear stress which is developed is substantially lessened and the tendency of the tie coat layer to delaminate is decreased or eliminated.

The adhesion of the tie coat composition to the metal substrate should be greater than that of the fireproofing composition with which it is used. The level of adhesion of the tie coat and fireproofing compositions to the metal substrate may be determined by methods well known in the art, e.g., in accordance with ASTM-E-736. For the testing of the adhesion of the tie coat composition by these methods, it is of course applied to the metal substrate in a continuous manner. The higher level of adhesion of the tie coat may be obtained, e.g., by proper choice of the inorganic binder, by increasing the relative amount of inorganic binder, or by the addition of agents which promote adhesion. For attaining the higher level of adhesion, the inorganic binder and, in particular, the relative amount of same will generally be such as to result in a relatively dense and rigid composition after setting. Generally the density and the resultant rigidity of the set tie coat composition will be greater than that of the set fireproofing composition. It is preferred to employ tie coat compositions having a density after setting in the range of about 15 to 150 lbs./ft$^3$., more preferably about 20 to 120 lbs./ft.$^3$. The fireproofing compositions used in this invention will normally be less dense that the tie coat composition and have a density after setting in the range of 13 to 30 lbs./ft$^3$. Reference to the density "after setting" is intended to refer to the density of the tie coat composition either after undergoing substantially complete hardening and evaporation of any carrier solvents, e.g., as with hardenable materials which are not hydraulic cements, or, in the case of hydraulic cementitious binders, after undergoing substantially complete hydration and allowing the hydrated material to dry. The latter definition of density "after setting" also applies to the hydraulic cement-based fireproofing compositions used herein.

The relatively dense and more rigid tie coat compositions normally used in this invention would tend to delaminate more readily from the metal substrate under conditions of shear stress if applied in a continuous layer. The provision of discontinuites in the tie coat layer is thus of particular advantage in reducing the effective rigidty of the layer and permitting satisfactory use of these compositions.

As used herein, the term "coverage" refers to the percentage of the total area of the metal substrate surface which is covered by the discontinuous tie coat layer. The coverage thus quantifies the extent of discontinuity in the tie coat layer. A tie coat layer of this invention may perform satisfactorily at a variety of coverages, which may vary within relatively wide limits. A suitable range of coverages for the tie coat layer may depend, for example, on the type of metal substrate, the total surface area desired for bonding with the fireproofing, the adhesiveness between the tie coat and substrate and tie coat and fireproofing composition, the relative rigidity of the tie coat composition, and the conditions of use of the fireproofed structural member. It is within the present invention to employ discontinuous tie coat layers with a coverage of as little as about 1% to as much as about 99% of the substrate surface area. As a general rule, a satisfactory range of coverage is that which at its lower limit provides a minimum acceptable level of increased surface area for bonding with the fireproofing and at its upper limit still provides a layer which is sufficiently discontinuous to satisfactorily accomodate flexing or deformation of the substrate and thus prevent premature delamination of the tie coat. A preferred range of coverage for the tie coat layer is about 20% to 80% of the substrate surface, more preferably about 40% to 70%.

Figure 3:
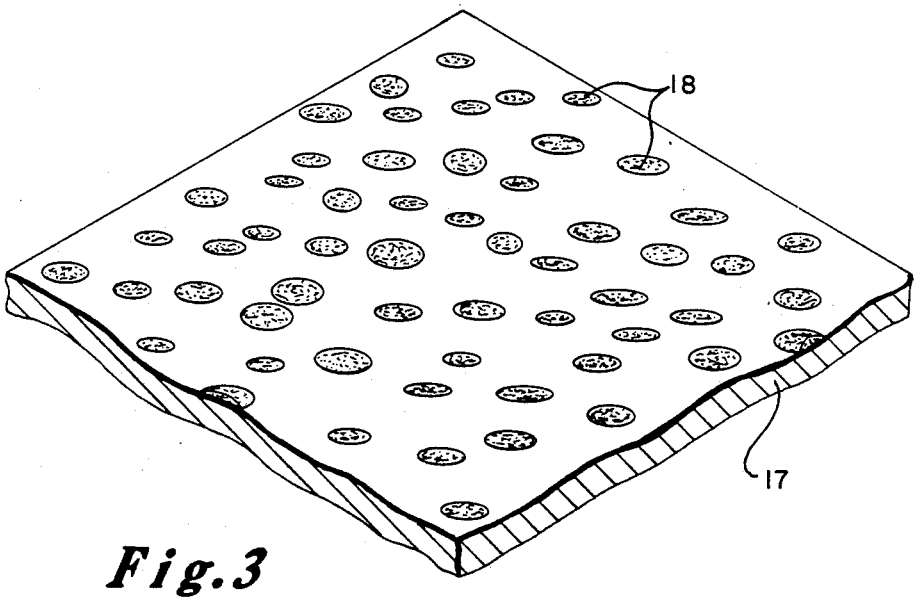
FIG. 3 is an elevated perspective view of a metal substrate having applied to one of its surfaces a tie coat layer of the invention which is differently configured from that of FIG. 2.

The various segments of the tie coat layer should be distributed on the metal substrate in a fairly regular fashion. As illustrated by FIG. 2, however, the individual segments of the layer can vary widely in size and shape and be randomly distributed. The particular configuration of the layer can depend, for example, on the method of application and the type of tie coat composition used to form the layer. Layers such that shown in FIG. 2 may be formed, for example, by spray application through a relatively wide orifice using a composition containing large aggregate and having little or no tendency to flow on the substrate surface. Alternatively, the tie coat layer may consist of discreet segments which are comparatively uniform in size and shape and are arranged more or less symetrically on the substrate. A tie coat layer of this type is illustrated in FIG. 3, wherein a metal substrate 17 is coated with a tie coat layer 18. The layer 18 is shown to consist of discreet segments which are more symetrically distributed than in the tie coat layer of FIG. 2, smoother surfaced, smaller in size, and more uniform in size and shape. Layers of this type may be formed, for example, by spray application through a relatively small orifice using compositions which do not contain large aggregate and/or tend to flow to a limited extent after application. A typical example of such compositions are the commercially available masonry paints.

The average thickness of the tie coat layer, which is defined as the average maximum height of the discreet segments of the layer, and the variation in thickness between the segments can vary with the method of application to the substrate, the flowability of the applied tie coat compositions, and the presence of aggregate, fibers, and the like in the composition. Preferably, the average thickness of the layer is in the range of about 1/64 inch to ¼ inch. A more preferred range is 1/16 inch to 3/16 inch. Tie coat layers such as that illustrated in FIG. 3 tend to have an average thickness in the low end of the preferred range, e.g., about 1/64 inch to 1/32 inch. The relative thinness of these layers may be due to the method of application, such as the aforementioned spray application through a small orifice, the ability of the tie coat composition to flow to a limited extent, high atomizing air pressure in spraying or the absence of large aggregate in the composition. Conversely, tie coat layers such as that illustrated in FIG. 2 tend to have an average thickness in the upper end of the preferred range, e.g., about 1/16 inch to 1/64 inch. This may derive as well from the method of application, such as spray application through a relatively large orifice, a tendency of the tie coat composition not to flow after application, low atomizing air pressure in spraying, or the presence of relatively large aggregate in the composition.

Inorganic binders which can be used in the tie coat compositions include magnesium oxychloride, magnesion oxysulfate, and the hydraulic cements, e.g., Plaster of Paris, Portland cement, aluminous cement, or pozzolanic cement. Portland cement is the preferred inorganic binder. The minimum amount of the inorganic binder which can be used in the tie coat composition is that which is necessary to obtain a cohesive tie coat layer with the desired adhesion. Based on the total weight of the solid components in the composition, i.e., the total weight of the dry composition prior to the addition of water or carrier fluids, the inorganic binder is usually present in an amount of at least 10% by weight. Ordinarily, the tie coat composition contains from about 20% to 100% by weight of inorganic binder, based on the total weight of the solid components. Where the tie coat composition and fireproofing composition comprise the same inorganic binder, the increased adhesion of the tie coat layer to the metal substrate (versus the adhesion of the fireproofing composition) is normally attained by use of a higher concentration of the binder in the tie coat composition, resulting in a tie coat composition having a higher density and a greater degree of adherence to the metal substrate.

The tie coat layer may consist entirely of the inorganic binder. For example, tie coat layers consisting of hydrated Portland cement, formed by spray application of a 100% Portland cement slurry, have been found to perform satisfactorily. However, in general the tie coat layer will include other addenda which are well known in the art for use in inorganic binder compositions. the composition may thus contain viscosity modifying agents; inert aggregate, e.g., sand, expanded or unexpanded vermiculite, perlite, sand, vermiculite, glass beads, and the like; organic fibers, e.g., cellulose fibers; inorganic fibers, e.g., glass fibers; hydraulic cement set retarders, set accelerators, water reducing agents, and air entraining agents; stabilizers; organic and inorganic adhesion promoters; and organic binders,e.g., acrylic latexes, acrylic powders, and various other organic polymers. From the standpoint of maximizing fire and heat resistance, it is preferred to employ tie coat compositions consisting entirely of inorganic materials or which include a minimal amount of organic materials, In general, the maximum acceptable level of organic material will vary inversely with the thickness of the tie coat layer.

A preferred tie coat layer of this invention is that comprising about 55% to 85% percent by weight, more preferably about 60% to 75% of Portland cement, about 10 to 40% by weight, more preferably about 15% to 30% of inorganic aggregate, such as expanded vermiculite, and about 1% to 15% by weight, more preferably about 3% to 15% of a fibrous material. An air entrainment agent is also preferably added to such compositions, as well as any stabilizers necessary to maintain air entrainment.

The tie coat compositions used in this invention are settable compositions which are applied to the metal substrate as a slurry and then set to form a hardened layer. The setting may occur as a result of hydration of the inorganic binder, removal of the slurry carrier fluid (generally by evaporation), or a combination of both. The setting time of the applied composition is generally not a critical factor and the composition may set before or after application of the fireproofing composition. Where the setting of the layer involves hydration of the inorganic binder, the water of hydration may be provided by the slurry carrier fluid or by application of the aqueous-based fireproofing composition.

The tie coat composition can be supplied to the job site in the form of a spreadable or pumpable slurry. Alternatively, the composition can be supplied in dry form, i.e., as a flowable, dry powder or granular mixture, and mixed with water or an organic carrier fluid at the job site to form a spreadable or pumpable slurry. Aqueous-based slurries are preferred from the standpoint of cost, ease of use, and environmental concerns.

The fireproofing layer of the structural members of this invention thermally insulates the underlying metal substrate and thereby prevents or retards distortion or degradation of the metal in high temperature environments. Any fireproofing composition which can be satisfactorily applied to the metal substrate/tie coat surface can be used in this invention. The preferred fireproofing compositions are those which can be directly sprayed onto the metal substrate/tie coat. These compositions include sprayable fiber products, e.g. consisting of mineral wood and small amounts of Portland cement, foamed magnesium oxychloride, and, most preferably, sprayable cementitious compositions containing a hydraulic cement binder, e.g. Plaster of Paris or Portland cement. These compositions and methods of applying them are well known in the art and ar not, per se, a part of this invention. Any of the commercially available sprayable fireproofing compositions can be used in this invention.

Of the sprayable fireproofing compositions containing a hydraulic cement binder, those containing Plaster of Paris as a hydratable binder are especially preferred for use in this invention. These settable compositions are applied as aqueous slurries and, during setting, the Plastic of Paris is hydrated to gypsum. These compositions are thus commonly referred to in the alternative as being gypsum-based. The fireproofing performance of these compositions is derived from their low effective thermal conductivity (due to a porous microstructure), their non-combustibility, and their ability to absorb heat due to calcination of the gypsum. Calcination of the gypsum involves the liberation of the water of hydration of the gypsum at about 300° F. The water can migrate to the interface between the fireproofing layer and metal/tie coat surface. The tie coat layer used in conjunction with gypsum-based fireproofing compositions should be sufficiently water stable to prevent or minimze any potential adverse effect of the water migration, and particularly to prevent or minimize any weakening of the bond between the fireproofing and the metal/tie coat surface. According to this invention, the Portland cement-based tie coat layers provide especially satisfactorily performance in terms of their water stability and are thus preferred for use with gypsum-based fireproofing. The Portland cement-based tie coat layers are also preferred in that those layers comprising 20% by weight of Portland cement or greater have a relatively high degree of adhesion to steel, as compared to that of the commercially available gypsum-based fireproofing compositions.

The method of the invention comprises the steps of applying the settable tie coat composition to a surface of the metal substrate in a discontinuous manner, thereby forming the discontinuous tie coat layer of this invention, and then applying a continuous layer of a fireproofing composition to the tie coat layer and to the exposed areas of the metal substrate surface. The fireproofing composition may be applied to the tie coat layer/metal surface at any time after application of the tie coat composition. It is preferred, however, to allow at least partial setting of the tie coat composition prior to applying the fireproofing layer, and the tie required for such partial or complete setting will vary with the tie coat composition. With the preferred Portland cement-based tie coat compositions of this invention, the fireproofing composition is preferably applied at about one hour or later after application of the tie coat composition. After this approximately one hour period, the time of application of the fireproofing is not critical and the performance of the tie coat layer, in terms of maintaining lamination of the fireproofing composition, does not vary significantly. This may be of particular advantage at a construction job site where the time lapse between application of the respective layers may vary widely. In addition, the ability to apply the fireproofing composition at a relatively short period of time after application of the tie coat composition can be advantageous in allowing a more efficient use of equipment and labor.

The tie coat composition can be applied by any means which provide a suitable discontinuous layer. Although spray application is generally preferred, the tie coat composition may be satisfactorily applied by means such as brushing or a textured roller. For spray application, conventional spray equipment may be employed, e.g., a pressurized paint gun, a plasterer's hopper gun, or conventional equipment used for the spray application of cementitious fireproofing materials.

The application of the fireproofing composition to the tie coat/metal surface may be carried out in the same manner as previously known in the art. Spray application is generally preferred. The fireproofing is normally applied to a total thickness of about ¾ inch to 2 inch, depending on the degree of fire protection required by building codes. The preferred sprayable gypsum-based fireproofing compositions of this invention, which typically have a wet density in the range of about 30 to 60 lbs./ft.$^3$, are generally spray applied utilizing a source air pressure of about 10 to 100 psi.

The present invention is further described in the following Examples, which are illustrative only. In each of the laminates prepared in the following Examples, the ability of the tie coat layer to remain laminated to the metal substrate, and to maintain lamination of the fireproofing layer, under conditions of high heat and shear stress, was evaluated by the following test procedure.

Each of the laminate samples, including comparative samples without a tie coat layer or with a continuous tie coat layer, were conditioned by allowing the samples to remain at room temperature for five days and in an over at 115° F. for two days. The samples were then placed in a furnace and subjected to increasing temperatures at a rate conforming to the time versus temperature profile set forth in ATSM E-119. The temperature at the interface of the tie coat layer and metal surface was monitored by means of a thermocouple. The maximum interface temperature used in this test procedure was 1000° F. The plate was suspended in the furnace with the fireproofed surface facing downward and supported about its periphery. The furnace was equipped through its upper surface with a large diameter screw which impinged on the temperature upper surface of the plate. Downward rotation of this screw was used to cause deflection or bending of the plate during the heating cycle. The amount of induced deflection was increased as the interface temperature increased, with the maximum deflection being about ½ inch at an interface temperature of 1000° F. After reaching the maximum temperature, the screw was backed off to remove the deflection pressure and the plate was allowed to cool gradually to room temperature. The adherence of the tie-coat/fireproofing system to the metal plate was monitored during the heating and cooling periods. These test procedure was designed to simulate the conditions to which the laminate would be subjected in an actual building fire and, for convenience, is referred to hereafter as the "fire test".

EXAMPLE 1

Three tie coat compositions were prepared as sprayable aqueous slurries as follows:

Tie coat composition A: A dry blend was prepared of about 15.7 pounds an a Type I Portland cement, about 23.3 pounds of #60 sand, about 0.8 pounds of lime, and about 0.18 pounds of #4 grade expanded vermiculite (per ASTM C-516 Standards). The dry bland (total weight of about forty pounds) was mixed with about 1 gallon of water for about 2 minutes to prepare a sprayable slurry. The density of the slurry prior to spraying (hereinafter "wet density") was about 125 lbs./ft.$^3$. In order to approximate the density of the slurry after application to the substrate and hydration and drying, a "dry density" was determined for a known volume of slurry sample which was allowed to hydrate and then dried in a 120° F. oven. Reference hereinafter to the "dry density" refers to the density of slurry samples which were conditioned in this manner. The dry density of composition A was about 111 lbs./ft.$^3$.

Tie coat composition B: About 40.2 pounds of a Portland cement-based composition sold as a fireproofing overcoat by W. R. Grace and Co., Cambridge, Mass. under the trademark Topkrete 210 were admixed with about 2 gallons of water for 2 minutes to prepare a sprayable slurry. The wet density and dry density of the slurry were measured as 77 lbs./ft$^3$ and 62.3 lbs./ft.$^3$ respectively.

Tie coat composition C: About 6.6 pounds of a Portland cement-based fireproofing composition sold by W. R. Grace and Co. under the trademark "Zonolite 105" were admixed with about 1.5 gallons of water for about 2 minutes to prepare a sprayable slurry. The wet density and dry density of the slurry were measured as 37.1 lbs./ft.$^3$ and 19.2 lbs./ft.$^3$, respectively.

Each of the tie coat compositions A, B, and C was spray applied to two 14×14 inch plates of 20 gauge galvanized steel. These were McFab Steel Co. plates with a small "spangle" or galvanized metal pattern. The compositions were sprayed with a conventional plastering spray gun at an atomizing air pressure of 20 psi. In each case, the applied slurry covered approximately ⅔ of the surface of the steel plate, the remaining ⅓ of the plate surface being uncoated by the composition and exposed. The appearance of the applied slurries was similar to that of the tie coat layer shown in FIG. 2 of this application.

Two sprayable fireproofing composition slurries of different density were prepared by mixing a dry gypsum-based fireproofing composition sold by W. R. Grace and Co. under the trademark "Monokote" (MK-5 variety) with water at different ratios. The "high" density slurry was prepared by mixing of about 11 pounds of the fireproofing with about 2.4 gallons of water. The wet and dry densities of the slurry (determined as above for the tie coat slurries) were about 43 lbs./ft.$^3$ and 20 lbs./ft.$^3$, respectively. The "low" density slurry was prepared by mixing of about 7.7 pounds of the fireproofing with about 1.8 gallons of water. The web and dry densities of the slurry were about 41 lbs./ft.$^3$ and 17 lbs./ft.$^3$, respectively.

Each of the fireproofing compositions was spray applied in a continuous layer to each of the steel plates bearing tie coat compositions A, B, and C about one hour after application of the tie coat compositions. Conventional fireproofing spray equipment was used at a source air pressure of 48 psi for the high density composition and 15 psi for the low density composition. The Monokote slurries contacted both the exposed steel surface and tie coat surface and were applied to a final thickness of about ¾ inch.

For comparison, the high and low density fireproofing compositions were spray applied as above to the same steel plate without a tie coat layer being present.

The thus prepared plate samples were subjected to the above described fire test. Under the conditions of this test, the high and low density fireproofing layers separated from and fell off the steel plate samples which did not include a tie coat layer. The high density fireproofing delaminated essentially as a single sheet from the steel plate at an interface temperature of 324° F., 21 minutes into the heating cycle. The low density fireproofing delaminated similarly at an interface temperature of 450° F., 33½ minutes into the heating cycle.

In all of those plates which included a tie coat layer, the fireproofing layer developed cracks but remained fully adhered during the fire test. Thus, in each case the maximum interface temperature of 1000° F. and maximum deflection of ½ inch were reached without delamination of the tie coat layer or fireproofing layer and, similarly, these layers remained laminated to the plate during and after the cooling period.

EXAMPLE 2

Tie coat compositions A, B, and C were again prepared as described in Example 1. The respective wet densities were 127.4, 77.4 and 39.5 lbs./ft.$^3$ and the respective dry densities were 117.5, 65.5, and 22.5 lbs./ft$^3$. Each composition was spray applied to a large spangle galvanized 14×14 inch McFab Steel plate in the manner described above. In addition, each tie coat composition was applied to the large spangle plate in a continuous manner such that 100% of the surface area was covered.

A fireproofing composition was prepared similar to that of the "low density" fireproofing composition of Example 1 and had respective wet and dry densities of about 43 lbs./ft.$^3$ and 19 lbs./ft.$^3$. This composition was spray applied to each of the steel plates bearing the continuous and discontinuous tie coat layers using a source air pressure of 14 psi. The fireproofing was also applied to a plate sample without a tie coat layer, forming a continuous fireproofing layer about ¾ inch thick.

Under fire test conditions, the fireproofing layer remained laminated to the plate sample which did not include a tie coat layer, indicating that this particular steel provided a satisfactory bond with the fireproofing. Similarly, the continuously and discontinuously applied tie coat layers B and C remained lamainated to the steel under the fire test conditions, also due to the bonding capability of the steel. However, notwithstanding this bonding capability, the continuously applied layer of tie coat composition A delaminated from the steel. This result provides an illustration of the increased tendency of continuous tie coat layers to undergo separation under an imposed shear stress. This result also illustrates that the more dense and, thus more rigid tie coat layers, such as the coat layer A, have a greater tendency to undergo delamination. However, the discontinuously applied layer of tie coat composition A did remain laminated to the steel under fire test conditions. This illustrates the bonding advantage which can be provided by discontinuites in the tie coat layer and, furthermore, indicates that such a bonding advantage can be provided in the case of tie coat compositions having a relatively high density and rigidity.

EXAMPLE 3

A commercially available masonry paint was sprayed onto a 14×14 inch piece of 20 gauge galvanized Robertson steel to provide a discontinous tie coat layer covering about ⅔ of the surface of the plate. A pressurized paint sprayer was used to apply the masonry paint using an atomizing air pressure of about 30 psi. The appearance of the tie coat layer was similar to that of the tie coat layer shown in FIG. 3 of this application.

A sprayable fireproofing composition slurry was prepared by mixing about 11 pounds of Monokote MK-5 brand fireproofing with about 2.6 allons of water for about out minute. The wet and dry densities of the composition were 44.1 and 19.7 lbs./ft.$^3$, respectively.

The fireproofing slurry was sprayed onto the tie coat/steel surface about 24 hours after application of the tie coat, forming a discontinuous layer about ½ inch thick.

The fireproofing composition was also sprayed in a similar manner onto the same steel plate without first applying a tie coat layer. Under the fire test conditions, the fireproofing delaminated from the plate which had no tie coat, the delamination occurring at an interface temperature of 373° f., 0.30 inch deflection. The plate comprising the masonry paint tie coat layer was heated to the maximum interface temperature of 1000° F., fully deflected to 0.48 inch, and cooled to room temperature without any delamination of the tie coat or fireproofing layers.

The masonry paint used in this example was also applied as a continuous layer by brushing onto a 20 gauge galvanized steel plate supplied by Walker Deck Co. and Monokote brand fireproofing was applied thereover to a total thickness of about ½ inch. When subjected to the fire test conditions, the masonry paint layer delaminated from the steel plate in a single sheet during the cooling period, effecting removal of the fireproofing composition from the steel plate.

EXAMPLE 4

A tie coat composition as prepared by dry blending about 264 parts by weight of #3 grade expanded vermiculite (per ASTM C-516 Standards), about 752 parts by weight of a Type 1 Portland cement, about 50 parts by weight of cellulosic fiber in the form of shredded newspaper, about 2.3 parts by weight of an alpha olefin sulfonate air entraining agent, and about 2.3 parts by weight of an air entrainment stabilizer sold by Dow Chemical Co. under the tradename Methocel 228. About 13.2 pounds of the dry blend were mixed with about 2.8 gallons of water for 1½ minutes to prepare a sprayable slurry. The wet density and dry density of the slurry were measured as 45.2 and 21.2 lbs./ft.$^3$, respectively.

The slurry was spray applied to a 14×14 inch galvanized, 20 gauge steel plate. The slurry was sprayed using a conventional plastering spray gun at an atomizing air pressure of 28 psi and covered approximately ⅔ of the surface of the steel plate. The appearance of the resultant tie coat layer was similar to that shown in FIG. 2.

A sprayable fireproofing composition was prepared by mixing about 11 pounds of Monokote MK-5 with about 2.6 gallons of water. The wet and dry density of the slurry were about 40.7 and 15.6 lbs./ft.$^3$, respectively. The Monokote slurry was sprayed onto the steel plate bearing the tie coat layer. The slurry was applied as a continuous layer about one hour after application of the tie coat composition. Conventional fireproofing spray equipment was used at a source air pressure of 12 lbs./in.$^2$. For comparison, the Monokote fireproofing was also spray applied as a continuous layer to the same type of steel plate without a tie coat layer being present.

Under fire test conditions, the fireproofing layer delaminated from the steel plate sample which did not include the tie coat layer. Delamination occurred at an interface temperature of 600° F., 68 minutes into the heating cycle. In the plate sample including the tie coat layer, the maximum interface temperature of 1000° F. and maximum ½ inch deflection were reached without delamination of either the tie coat or fireproofing layer and, similarly, the layers remained fully laminated during and after the cooling period.

What we claim is:

1. A fire and heat resistant structural member comprising a metal substrate element, a discontinuous tie coat layer comprising an inorganic binder adhered to a surface of said metal substrate, and a layer of a hydraulic cement based fireproofing composition adhered to said tie coat layer and to the exposed area of said metal substrate surface.

2. A structural member of claim 1 wherein the density of said fireproofing layer is less than that of said tie coat layer.

3. A structural member of claim 2 wherein the density of said fireproofing layer is in the range of about 13 to 30 lbs./ft.$^3$ and the density of said tie coat layer is in the range of about 15 to 150 lbs./ft.$^3$.

4. A structural member of claim 1 wherein the coverage of said tie coat layer is in the range of about 1% to 99% of the surface area of said substrate surface.

5. A structural member of claim 4 wherein said coverage is in the range of about 20% to 80% of the surface area of said substrate surface.

6. A structural member of claim 5 wherein said coverage is in the range of about 40% to 70% of the surface area of said substrate surface.

7. A structural member of claim 1 wherein said tie coat layer has an average thickness in the range of about 1/64 inch to ¼ inch.

8. A structural member of claim 1 wherein said inorganic binder is selected from the group consisting of magnesium oxychloride, magnesium oxysulfate, Plaster of Paris, Portland cement, aluminous cement, and pozzolanic cement.

9. A structural member of claim 1 wherein said inorganic binder is Portland cement.

10. A structural member of claim 1 wherein said fireproofing composition comprises a gypsum binder.

11. A structural member of claim 1 wherein said tie coat layer comprises about 55% to 85% by weight of Portland cement, about 10% to 40% by weight of inorganic aggregate, and about 1% to 15% by weight of a fibrous material.

12. A structural member of claim 1 wherein the metal of said substrate element is steel.

13. A structural member of claim 1 wherein said tie coat layer comprises an organic binder.

14. A structural member of claim 1 wherein said tie coat layer and said fireproofing layer each comprise the same inorganic binder.

15. A fire and heat resistant structural member comprising a steel substrate element, a discontinuous layer of a tie coat composition comprising a Portland cement binder adhered to a surface of said steel substrate, said tie composition having a density in the range of about 15 to 150 lbs./ft.$^3$, and a layer of a fireproofing composition comprising a gypsum binder adhered to said discontinuous layer and to the exposed areas of said surface of said steel substrate element, said fireproofing composition having a density in the range of about 13 to 30 lbs./ft$^3$, wherein the density of said fireproofing composition is less that that of said tie coat composition.

16. A structural member of claim 15 wherein the coverage of said tie coat layer is in the range of about 20% to 80% of the surface area of said steel substrate surface.

17. A structural member of claim 15 wherein said tie coat layer comprises 20% by weight or greater of Portland cement.

18. A structural member of claim 15 wherein said tie coat layer comprises about 55% to 85% by weight of Portland cement, about 10% to 40% by weight of inorganic aggregate, and about 10% to 15% by weight of a fibrous material.

19. A structural member of claim 15 wherein said tie coat layer comprises an organic binder.

20. A method of fabricating a fire and heat resistant structural member comprising the steps of applying a settable tie coat composition comprising an inorganic binder to a surface of a metal structural element in a discontinuous manner to form a discontinuous tie coat layer and then applying a continuous layer of a hydraulic cement-based fireproofing composition to said tie coat layer and to the exposed areas of the metal structural element surface.

21. A method of claim 20 wherein said tie coat composition is spray applied to said surface.

22. A method of claim 20 wherein said fireproofing composition is spray applied to said tie coat layer and said exposed areas.

23. A method of claim 20 wherein said tie coat composition comprises a Portland cement binder and said fireproofing composition is applied at about one hour or later after application of said tie coat composition.

24. A method of claim 20 wherein said tie coat composition is applied in a manner resulting in a discontinuous tie coat layer having a coverage of about 1% to 99% of the surface area of said metal structural element surface.

25. A method of claim 24 wherein said coverage is about 20% to 80% of the surface area of said metal structural element surface.

* * * * *